United States Patent [19]

Wheatland

[11] Patent Number: 4,984,387

[45] Date of Patent: Jan. 15, 1991

[54] DOOR DRIVE MECHANISM ADAPTER UNIT

[75] Inventor: Graham Wheatland, Pointe-Claire, Canada

[73] Assignee: 501 Manaras Auto Doors, Inc., Aurent, Canada

[21] Appl. No.: 363,623

[22] Filed: Jun. 8, 1989

[51] Int. Cl.[5] ..... E05F 11/34

[52] U.S. Cl. ..... 49/362; 49/360; 160/188

[58] Field of Search ..... 49/199, 200, 360, 362; 160/188, 189, 190

[56] References Cited

U.S. PATENT DOCUMENTS

| | | | |
|---|---|---|---|
| 1,549,203 | 8/1925 | McClure | 49/360 |
| 1,916,651 | 7/1933 | Beeman et al. . | |
| 1,936,300 | 11/1933 | Guss . | |
| 2,023,909 | 12/1935 | Wread | 49/200 |
| 2,732,201 | 1/1956 | Franko | 160/188 |
| 2,747,864 | 5/1956 | Miller | 160/188 |
| 2,755,081 | 7/1956 | Johnson et al. | 160/188 |
| 3,152,368 | 10/1964 | Stuart | 49/362 |
| 3,280,888 | 10/1966 | Davis . | |
| 3,834,080 | 9/1974 | Lystad . | |
| 4,356,668 | 11/1982 | Wagner | 49/199 |
| 4,417,418 | 11/1983 | Warning | 160/188 |
| 4,538,661 | 9/1985 | Henry et al. | 160/189 |
| 4,656,780 | 4/1987 | Miyauchi et al. . | |
| 4,685,248 | 8/1987 | Hammond . | |
| 4,793,099 | 12/1988 | Friese et al. | 49/362 |
| 4,860,813 | 8/1989 | Ballyns et al. | 160/188 |

FOREIGN PATENT DOCUMENTS

| | | | |
|---|---|---|---|
| 244274 | 10/1962 | Australia | 49/200 |
| 2510306 | 3/1975 | Fed. Rep. of Germany | 49/200 |
| 255253 | 10/1927 | Italy | 49/342 |

*Primary Examiner*—Gary L. Smith
*Assistant Examiner*—Michael Milano
*Attorney, Agent, or Firm*—Samuel Meerkreebs

[57] ABSTRACT

An adapter unit for mechanically driven doors of the type such as garage doors are driven by a motor and guided at the sides thereof by guide rails mounted to a frame that defines the door opening. The adapter unit comprises an elongated member adapted to be mounted to the back side of the door receiving channel of one of the guide rails. The elongated member defines an elongated inverted U-shaped channel in which a chain is slidably received. A sprocket is rotatably mounted in the elongated member within a circular recess defined in the channel for engagement with the chain. The sprocket is further adapted to centrally engage a shaft of the motor to thus rotate therewith. A door drive mechanism is mounted at one end of the chain and is adapted to be removably coupled to a bracket provided on an inner lower part of the door. The sprocket and chain are adapted to remain engaged between the two extreme positions of the chain which correspond with the open and closed positions of the door. Therefore, upon actuation of the motor, the chain is displaced in the channel thereby causing movement of the door as it is linked thereto by the door drive mechanism engaged in the bracket.

19 Claims, 3 Drawing Sheets

20
18
16
10
M
12
22
16
30
28
P
D
14
24
H
30
46,62
A
26
38
46
44
83
40
38
42
46,87
14
4
4
40
46
42
46
74
90
88
92
110
106
30
98
96
100
102
104

A
44
64
56
58
76
60
68
72
74
80
66
70
78
46,62
85
83
46,87

DOOR DRIVE MECHANISM ADAPTER UNIT

BACKGROUND OF THE INVENTION

1. Field of the Invention

This invention relates to motor driven doors and, more particularly, to a universal adapter unit for conventional garage doors such as those that are guided by guide rails disposed at the sides thereof.

2. Description of the Prior Art

A general mechanism is basically used to actuate garage doors of the type that are vertical when closed and when opened are stored in an overhead, horizontal position. Such sliding garage doors are generally mounted on two guide rails, one on each side thereof, the door having guide rollers at each side to rotate inside the guide rails. The guide rails are elongated reversed L-shaped members that are partly rounded at their corner and that are mounted to the sides of the frame of the garage defining the opening thereof and to its ceiling. The guide rails define channels which face inwards to receive the rollers of the door for movement therein.

The general actuating mechanism for the above garage doors is characterized by having a motor mounted to the ceiling of the garage centrally and rearward of the door opening. The motor drives a sprocket engaging a chain which is generally connected to the inner surface of the top panel of the door so as to pull the door from a closed to an open position thereof, and vice versa.

The drive mechanism disclosed in U.S. Pat. No. 1,916,651 issued on July 4, 1933 to Beeman et al., shows such a system but for a motor which is mounted to one side of the garage ceiling. To open the door, the motor drives a pair of chains connected to the lower side inner ends of the door. The door is closed when the same chains act in an opposite direction and pull on members that have one end thereof slidably engaged in the guide rails and another end connected to the upper inner part of the door. This door drive mechanism thus results in a complex and space consuming arrangement of sprockets, chains, connection members and springs. Furthermore, to drive the door, a shaft is required to extend across the garage, thereby occupying some of the headroom thereof.

Some doors, such as the one disclosed in U.S. Pat. No. 1,936,300, issued on Nov. 21, 1933 to Guss, are mounted in series on both sides thereof with chains to produce a pair of motor driven endless loops. Again, the motor is mounted to the ceiling of the garage at least a door's height rearward of the door opening thereof to horizontally accommodate the door in its open position. This reduces the available headroom in the garage.

U.S. Pat. No. 3,280,888, issued on Oct. 25, 1966 to Davis, discloses a motorized folding overhead door driven by an endless chain connected thereto and guided by upstanding guide means provided on the inner sides of the door frame. This mechanism driving a folding-type door therefore does not necessitate rearward extending guide rails as all the components therefor, including the motor, are conveniently located near the door frame although they occupy substantial body space thereat.

U.S. Pat. No. 3,834,080, issued on Sept. 10, 1974 to Lystad, disclosed a window regulator for a station wagon tailgate window wherein a manually operated handle drives a pair of sprockets each engaging at the top thereof apertures provided on a pair of drive tapes which extend downward on each side of the sprockets. The drive tapes have an end thereof connected to a lower edge of the window so as to drive the window up or down within a window guide. Both sides of the tapes loosely overhang the sprockets within elongated guide sleeves without being guided therein.

U.S. Pat. No. 4,656,780, issued on Apr. 14, 1987 to Miyauchi et al., is similar to the Lystad Patent as a sprocket is in driving engagement with a drive ball assembly guided in an elongated ball guide so as to impart bidirectional linear movement to a window panel mounted to one end of the drive ball assembly. The other end of the drive ball assembly is spring loaded to the distal end of the ball guide with respect to the window panel in order to bias the drive ball assembly in a direction to urge the window panel toward its closed position.

U.S. Pat. No. 4,685,248, issued on Aug. 11, 1987 to Hammond, discloses a pinion driven rack that is slidably engaged in a track defining a generally rectangular channel. The rack is further connected to a window to impart movement thereto.

None of the above drive mechanisms provide for a unit universally adaptable to doors of the type that slide from a vertical position towards a horizontal position along guide rails disposed on each side thereof.

The above drive mechanisms intended for garage doors are somewhat cumbersome as they take up headroom generally in the central portion of the garage. Furthermore, these drive mechanisms are generally of rather complex construction.

SUMMARY OF THE INVENTION

It is therefore an aim of the present invention to provide a drive mechanism connecting a motor and a door that is also an adapter unit of universal use.

It is also an aim of the present invention to provide an adapter unit that is of simple construction and easily connectable to the motor and the door driven thereby.

It is still an aim of the present invention to provide an adapter unit that allows for the motor connected thereto to be mounted to the wall of the garage defining the door opening so as to be conveniently tucked away near a guide rail of the garage door.

It is still an aim of the present invention to provide an adapter unit that is less cumbersome than the present door drive mechanisms.

It is still an aim of the present invention to provide an adapter unit that can be disconnected from the door driven thereby to allow manual operation of the door.

It is still an aim of the present invention to provide an adapter unit which produces a more efficient locking of the door with respect to that produced by present door drive mechanisms.

It is still a further aim of the present invention to provide an adapter unit which results in a quiet operation of the door drive mechanism.

It is still a further aim of the present invention to provide an adapter unit that can be easily adapted to operate large or heavy doors.

A construction in accordance with the present invention comprises an adapter unit for mechanically driven doors of the type such as garage doors driven by a motor and guided at the sides thereof by guide rails mounted to a frame defining a door opening. The adapter unit comprises a body defining a channel means and a drive means adapted to be slidably engaged in the channel means. The drive means is further adapted to be coupled and driven by the motor and to be connected to the door for the driving thereof between open and closed positions thereof. Therefore, upon actuation of the motor, the drive means is displaced in the channel means to move the door in a direction dependent on that of the motor.

In a more specific construction in accordance with the present invention, the body is an elongated member mounted on a side of one guide rail opposite another side thereof defining a door receiving channel. The channel means of the elongated member comprises an elongated inverted U-shaped channel and the drive means includes a chain slidably engaged in the channel means for longitudinal movement therein.

In a still more specific construction in accordance with the present invention, the drive mechanism further comprises a sprocket rotatably mounted in the member within a circular recess defined in the channel for engagement with said chain between the two extreme positions thereof corresponding with the open and closed positions of the door. The sprockets are adapted to engage a shaft of the motor for rotation therewith. Two portions of the channel lower than the circular recess thereof extend substantially parallel downwards therefrom.

In a still more specific construction in accordance with the present invention, the drive means also comprises door drive means provided at the end of the chain positioned in the one of the two portions of the channel located furthest from the plane of the door. The door drive means are removably coupled to a bracket means provided on an inner lower side portion of the door.

In a still more specific construction in accordance with the present invention, the elongated member comprises a plurality of assembled sections a polyamide such as nylon. The sections are assembled in an aligned end-to-end relationship by an arrangement of a series of longitudinally extending pins mating with corresponding holes which are provided on one and the other ends of the sections. The elongated member formed is adhesively mounted to the side of the guide rail.

In a still more specific construction in accordance with the present invention, a further adapter unit is provided to be mounted on the guide rail associated with another side of the door. Coupling means are provided for connecting both the adapter units for joint action thereof.

In a still more specific construction in accordance with the present invention, the coupling means comprises a cable joining the door drive means of both the adapter units. The cable is guided by pulleys mounted inside the door frame at positions upward and outward of the door opening.

Another construction in accordance with the present invention comprises an adapter unit for doors having the sides thereof slidably engaged in guide rails. The adapter unit comprises a member defining a channel means and further comprises a chain means slidably engaged in the channel means and adapted to be coupled to the motor and to be connected to the door. Therefore, when the motor is actuated, the chain means is displaced in the channel means to thereby produce a movement of a door.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
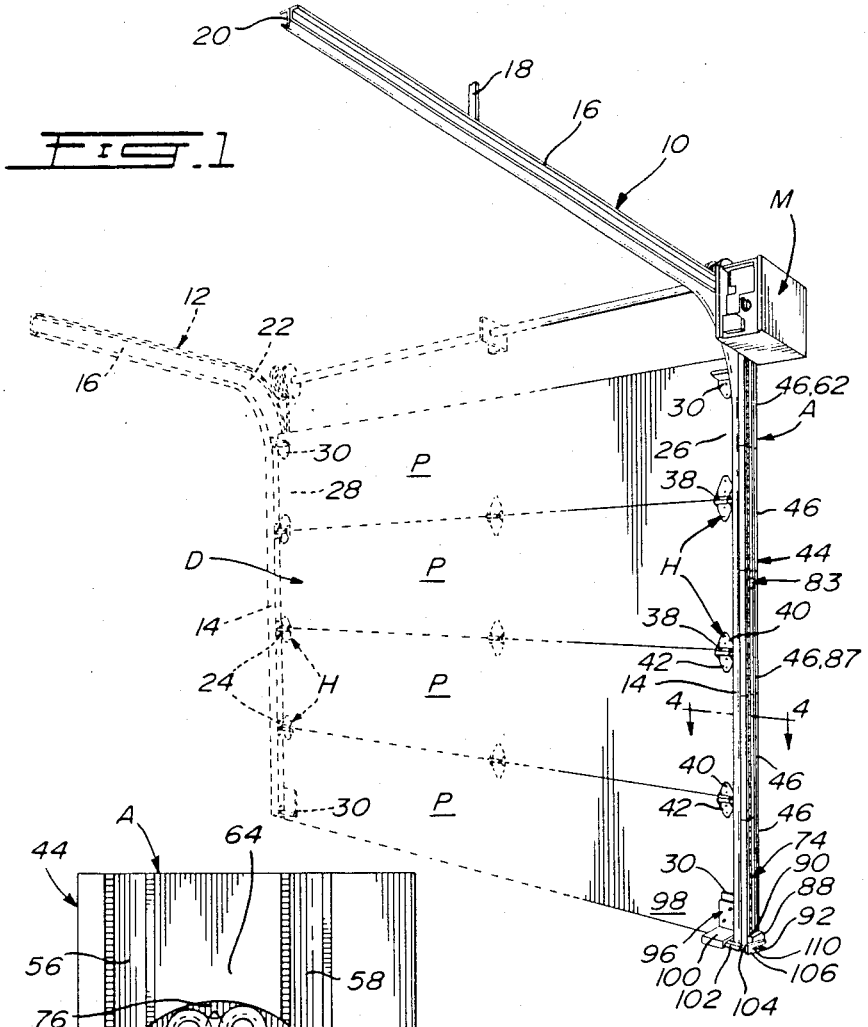
FIG. 1 is a perspective view illustrating a conventional motor driven garage door equipped with an adapter unit in accordance with the present invention.

In FIG. 1, a conventional garage door D includes in this case panels P, four, hinged together by hinges H to allow relative pivots of the panels P one to the other when they are driven, manually or by way of a motor M, along a pair of guide rails 10 and 12.

The guide rails 10 and 12 are inverted L-shaped members each having vertical and horizontal sections 14 and 16, respectively. The vertical sections 14 are fixed to the inner frame—which is not shown—adjacent each side of the door opening defined thereby. The horizontal sections 16 of the guide rails 10 and 12 are mounted to the ceiling of the garage by brackets 18.

Figure 4:
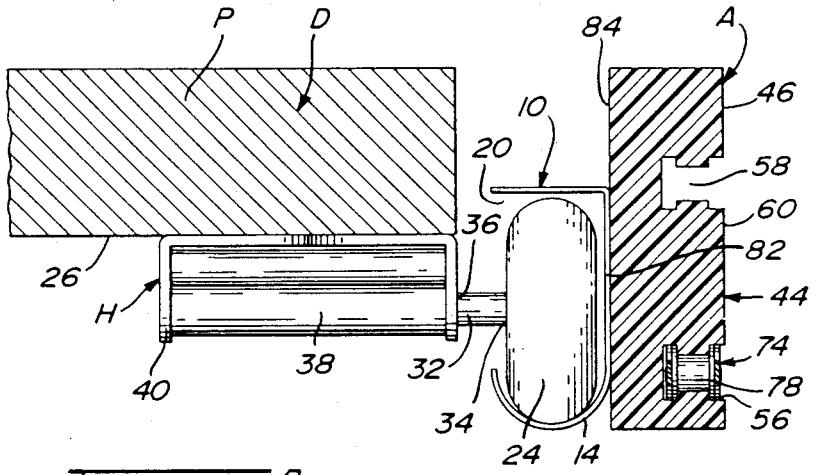
FIG. 4 is a cross-sectional top plan view taken along lines 4—4 of FIG. 1 of the chain housing channel and also showing the elongated member mounted to the door roller receiving guide rail.

As seen in FIGS. 1 and 4, the guide rails 10 and 12 each define an inward facing channel 20 and 22, respectively. These channels 20 and 22 are adapted to guide rollers 24 which are rotatably mounted to the inner side surfaces 26 and 28 of the garage door D at the hinges H and brackets 30 thereof. In FIG. 4, a typical roller 24 is shown to be rotatably mounted on a shaft 32 at one end 34 thereof. The shaft 32 is fixedly mounted at another end 36 thereof to a sleeve 38 provided at the junction of upper and lower pivoting parts 40 and 42 respectively of the hinge H associated therewith. The hinges H are mounted by screws to the panels P.

The present invention lies in an adapter unit A that joins the motor M to the door D in order that upon actuation of the motor M, the door D is driven along the guide rails 10 and 12 from an open to a closed position thereof, or vice versa.

Figure 3:
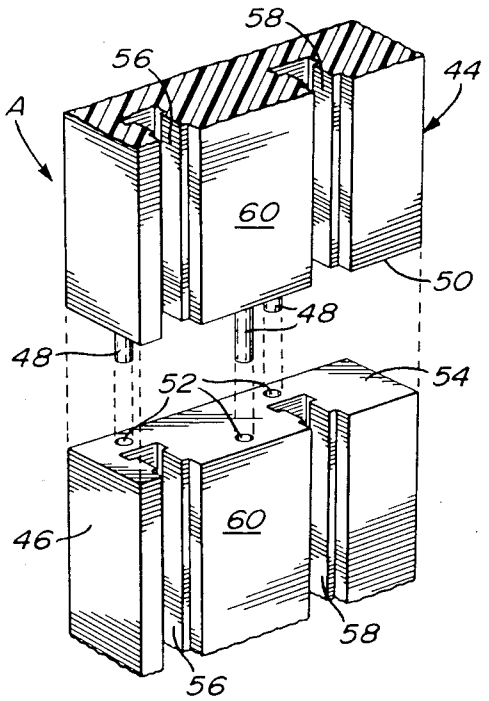
FIG. 3 is an exploded perspective view illustrating the assembly of a pair of sections forming part of the elongated member.

The adapter unit A comprises an elongated member 44 made of a series of aligned track sections 46 assembled in an end-to-end relationship. The track sections 46 are made of a plastic material. More particularly, a polyamide, such as nylon, is used due to its good mechanical properties, e.g. good resistance to friction, abrasion, fatigue and impact. As best seen in FIG. 3, the track sections 46 are assembled one to the other using a plurality of steel pins 48 extending longitudinally from lower end surfaces 50 thereof, the pins 48 being adapted to mate with corresponding holes 52 defined on upper end surfaces 54 of adjacent track sections 46.

A pair of longitudinal and parallel channels 56 and 58 are defined on the front surface 60 of each track section 46 in order to form continuous channels when the track sections 46 are assembled. The channels 56 and 58 are shown in FIG. 3 and the cross-section thereof is well illustrated in FIG. 4.

Figure 2:
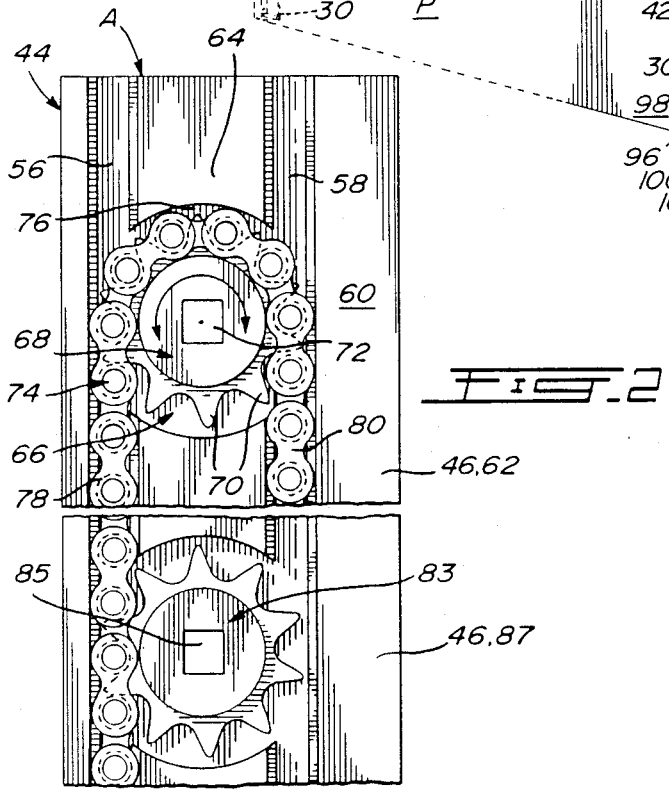
FIG. 2 is a side view of part of the adapter unit showing a portion of the elongated member of the adapter unit and, more particularly, the engagement of the chain with the sprocket and within the channels thereof.

An uppermost track section 62 of the track sections 46 includes near a top end 64 thereof a circular recess 66 defined on the front surface 60 thereof so as to merge with both the channels 56 and 58, as seen in FIG. 2. A sprocket wheel 68 is rotatably mounted in the center of that recess 66. The sprocket wheel 68 comprises a series of teeth 70 extending radially from the periphery thereof. The sprocket wheel 68 further includes an opening 72 defined centrally therein and having, in this embodiment, a square-shaped configuration. A chain 74 having a cross-section—taken at the junction of a pair of links thereof—similar to that of the channels 56 and 58. The chain 74 is of smaller dimensions than the channels so that it may be slidably engaged therein, as best seen in FIG. 4.

Now referring to FIG. 2, the chain 74 also engages the sprocket wheel 68 in a top section 76 of the circular recess 66. Each end of the chain 74 lies in one of the channels 56 and 58. The rotation of the sprocket wheel 68 will therefore produce longitudinal and opposite displacements of sections 78 and 80 of the chain 74 respectively associated with the channels 56 and 58.

The track sections 46 are mounted at the rear surfaces 84 thereof to the side surface 82 of the guide rail 10 opposite the channel 20 thereof in order that the channels 56 and 58 face outward of the guide rail 10, that is opposite from the channel 20 thereof. In this embodiment, the track sections 46 are adhesively mounted to the guide rail 10 using heavy duty double-sided tape. Screws could be used as long as no part thereof protrude in the recess 20 of the guide rail 10 in a way hindering the movement of the rollers 24 therein. The positioning of the track sections 46 with respect to the guide rail 10 is best illustrated in FIGS. 1 and 4. Due to the rounded corner of the guide rail 10, the top part of the uppermost track section 62 might not be in full contact with the side surface 82 thereof.

An idler sprocket 83 may be provided mid height of the elongated member 44 and, more particularly, in a track section 87 of the track sections 46. The track section 87 is identical to the uppermost track section 62. The idler sprocket 83 includes a square socket 85 which can serve to receive a manual tool for manual rewinding in the event of an emergency.

The motor M is mounted on an inner wall of the garage further from the door opening than the uppermost track section 62 and at a level so that a distal end of an output shaft 86 of the motor M can be engaged in the square opening 72 of the sprocket wheel 68 for rotation therewith. This is somewhat illustrated in FIG. 6.

A drive block 88 is fixedly mounted to an end 90 of the chain section 78 lodged in the channel 56, that is the channel that is furthest from the wall of the garage defining the door opening. The end of the chain section 80 which lies in the channel 58 is free.

Figure 5:
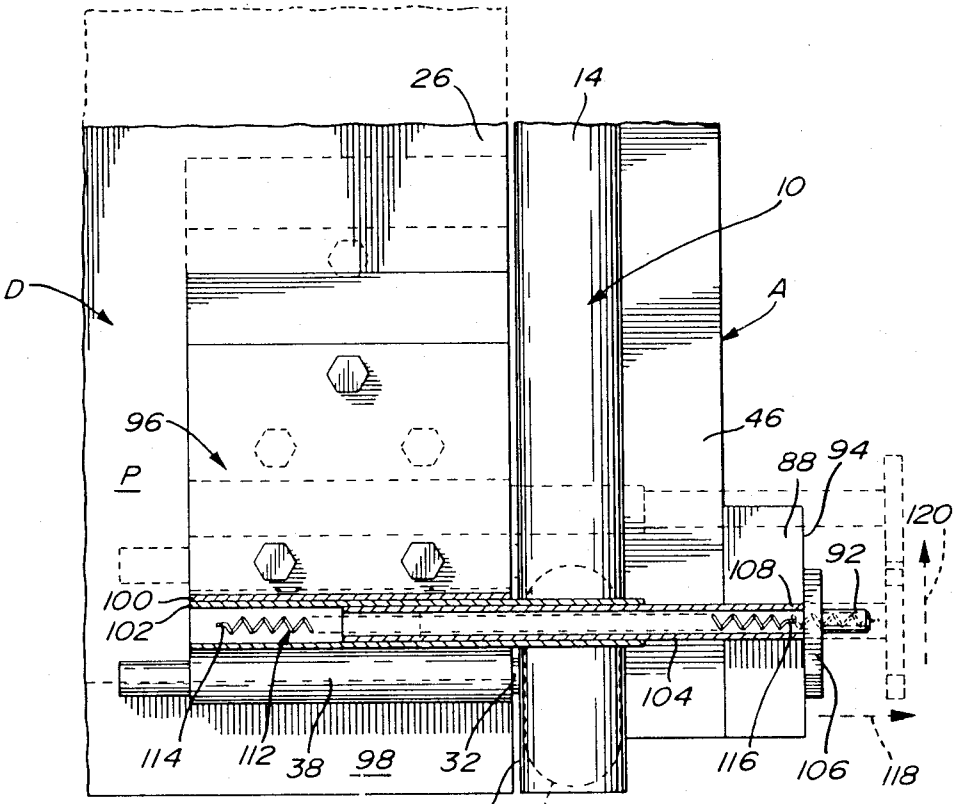
FIG. 5 is a front elevation view partly in cross-section showing the connection means between the adapter unit and the door and, in dotted lines, the disengagement thereof.

A pin 92 is fixedly mounted to an outer side surface 94 of the drive block 88 so as to extend at right angles therefrom, as seen in FIGS. 1 and 5. A bracket 96 is bolted to an inner lower side surface 98 of the garage door D so as to overlie the lower bracket 30 associated therewith. A part 100 of the bracket 96 which extends at right angles outwards therefrom is provided with an elongated sleeve 102 of square cross-section. A spring loaded tubular elongated arm 104 also of square cross-section is slidably engaged in the sleeve 102. A substantially flat connection member 106 is fixedly mounted at an end 108 of the tubular arm 104 and extends towards the pin 92 of the drive block 88. The connection member 106 is provided with an indent 110 into which the pin 92 can nest, as seen in FIG. 1.

The tubular arm 104 is spring loaded by way of a spring 112 longitudinally disposed within the tubular arm 104, the spring 112 being basically at rest in the position thereof shown in full lines in FIG. 5. A first end 114 of the spring 112 is hooked to a side wall of the sleeve 102 by way of a small opening defined therein. A second end 116 of the spring 112 is similarly hooked to a sidewall of the tubular arm 104.

This construction allows for the connection member 106 of the tubular arm 104 to be disengaged from the pin 92 of the drive block 88 and thus of the adapter unit A to permit manual operation of the door. As seen by the dotted lines on FIG. 5, this is done by pulling the connection member 106 in a direction shown by arrow 118, that is away from the drive block 88, to thus release the pin 92 from the indent 110 of the connection member 106. The door D is then moved upwards to displace the tubular arm 104 and thus the connection member 106 in a direction shown by arrow 120. Once the connection member 106 clears the pin 92, as shown by the dotted lines on FIG. 5, it can be released so as to return to its original position with respect to the sleeve 102 under the action of the extended spring 112.

The operation of the door D using the hereinabove described adapter unit A is simple and follows hereinafter. Upon actuation of the motor M, the output shaft 86 thereof is rotated in a suitable direction and thus produces the rotation of the sprocket wheel 68 of the adapter unit A and therefore, the longitudinal displacement of the chain 74 along the channels 56 and 58. The end 90 of the chain 74 which lies in the channel 56 being fixed to the drive block 88 thus drives the tubular arm 104 and therefore the sleeve 102 and the door D in the same direction as that of the chain section 78 which is in the channel 56. Obviously, if the connection member 106 is disengaged from the pin 92 of the drive block 88, the drive block 88 will move without any associated movement of the door D. The sleeve 102 and the tubular arm 104 have a square cross-section so that the tubular arm 104 cannot rotate within the sleeve 102 when it is subject to the load resulting from the action of the drive block 88 on the pin 92 thereof.

To open the door D, the output shaft 86 of the motor M must rotate so as to drive the sprocket wheel 68 in a clockwise direction when referring to FIG. 2. The chain section 78 which lies in the channel 56 will thus move upwards and pull the drive block 88 and thus the door D in that same direction. A reverse rotation of the motor causes the door D to close as the chain section 78 located in the recess 56 moves downwards thereby pushing the drive block 88 mounted at its lower end downwards along with the door D.

Figure 6:
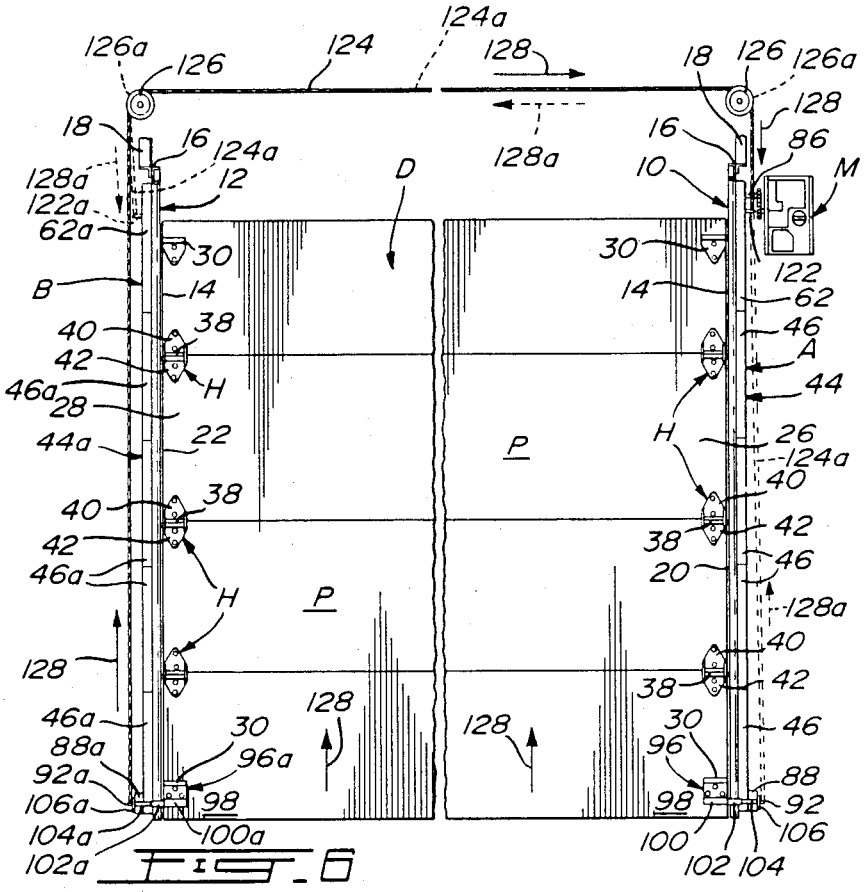
FIG. 6 is a front elevation view illustrating adapter units according to the present invention provided on both guide rails of the garage door and further illustrating the coupling between both these adapter units.

FIG. 6 shows a further construction embodying the present invention. When large or heavy doors D are to be driven, a further adapter unit B can be mounted on the other guide rail, that is guide rail 12. Both adapter units A and B are basically identical, with the numerals corresponding to parts of the adapter unit B being characterized by the addition of the suffix "a" thereto.

In order that only one motor M is used, a member 122 is mounted to the end of the section 80 of the chain 74 that lies in the channel 58, that is the end of the chain 74 that is not equipped with the drive block 88. The member 122 is connected to the pin 92*a* of the second adapter unit B by way of a cable 124 which is guided by pulleys 126 to maintain headroom in the garage. Alternately, the shaft 86 of the motor M could extend across the garage to drive the sprocket wheel 68*a* of the second adapter unit B, but that would require a strong shaft as well as bearings. This construction would also reduce the headroom provided in the garage.

The arrows 128 of FIG. 6, show the displacement of the door D and of the cable 124 upon actuation of the motor M with a view of opening the door D. In such a case, the drive block 88 of the first adapter unit A is pulled upwards which forces the connecting member 122 downwards thereby pulling on the cable 124 so as to urge upwards the drive block 88*a* of the second adapter unit B. Both drive blocks 88 and 88*a* pulling upwards simultaneously, the door D is urged upwards without torsion.

When the door is closed, the drive block 88 of the adapter unit A is forced downwards, whereby the connecting member 122 moves upwards. The cable 124 being non elastic, the drive block 88*a* of the second adapter unit B follows the movement thereof against the forces of gravity to thereby keep both drive blocks 88 and 88*a* at a same level. This prevents any contortion of the door D.

The construction in dotted lines on FIG. 6 represents a further embodiment for large or heavy doors, wherein the two adapter units A and B are identical. The other end of the chain of the adapter unit B, that is the end thereof not adapted with the drive block 88*a*, is provided with a member 122*a* which is joined to the pin 92 of the drive block 88 of the adapter unit A by way of a cable 124*a* guided by pulleys 126*a*. Double-pulleys embodying pulleys 126 and 126*a* are used on each side of the door D. As above, the arrows 128*a* illustrate the displacement of the member 122*a* and of the cable 124*a* upon opening of the door D. The upward movement of the guide block 88*a* results in the associated downward displacement of the member 122*a* which therefore pulls on the cable 124*a* to pull upward the drive block 88 of the adapter unit A.

The adapter unit according to the present invention thus allows for a practical, that is non cumbersome, mounting of the motor in the garage. The sprocket wheel that drives the chain is universally adapted to receive any motor output shaft. The adapter unit is also disconnectable from the door so as to permit manual operation thereof. The nylon construction of the track sections result in a quiet operation of the adapter unit and thus of the door as a whole. Locking of the door is also ensured by the use of this adapter unit.

Furthermore, if the door stops in an intermediate position due to, for instance, the detection of an object by a load sensor acting on the motor, the door remains locked into that intermediate position until further actuation of the motor thereby providing safety to the door. On conventional drive machanisms, cables loosely unwind from their winches which can cause the fall under gravity of the door and thus injury or damage.

The adapter unit is thus a very compact system that is universal and easily installed. It is safe, quiet and easily disconnectable to allow manual operation of the door. The elimination of the conventional overhead central T-bar greatly increases the headroom available in the garage.

I claim:

1. An adapter unit for mechanically driven doors of the type such as garage doors driven by a motor and guided at sides thereof by guide rails mounted at least to a frame defining a door opening, comprising a body defining an elongated channel means, a drive means including a push-pull flexible elongated drive member slidably engaged in said channel means for longitudinal movement therein while being by said body to prevent lateral deflection of said member therein restrained, said drive means being coupled and driven by the motor and being connected to the door for the driving thereof between open and closed positions thereof, whereby upon actuation of the motor, said flexible elongated drive member is displaced in said channel means thereby forcing a movement of the door in a direction dependent on that of the motor.

2. An adapter unit as defined in claim 1, wherein said flexible elongated drive member comprises a chain slidably engaged in said channel means.

3. An adapter unit as defined in claim 2, wherein said body is an elongated member mounted parallel to one guide rail defining a door receiving channel, and wherein said channel means comprises an elongated channel having a shape of one of a "U" and an inverted "U".

4. An adapter unit as defined in claim 3, wherein said drive means further comprises a sprocket rotatably mounted in said member within a circular recess defined in said channel for engagement with said chain between the two extreme positions thereof corresponding with the open and closed positions of the door, said sprocket including means for connection to a drive shaft of the motor for rotation therewith, two portions of said channel lower than said circular recess thereof extending substantially parallel downwards therefrom.

5. An adapter unit as defined in claim 4, wherein the motor is positioned outward of said sprocket with respect to the frame of the door opening.

6. An adapter unit as defined in claim 4, wherein said drive means comprises door drive means provided at a first end of said chain positioned in the one of said two portions of said channel located furthest from the plane of the door, said door drive means being removably engaged to a bracket means provided on an inner lower side portion of the door.

7. An adapter unit as defined in claim 6, wherein said chain positioned in the one of said two portions located closest from the plane of the door includes a second end.

8. An adapter unit as defined in claim 3, wherein said channel has a cross-section similar but slightly larger than that of said chain taken at the junction of a pair of links thereof, thereby ensuring slidability of said chain in said channel and further ensuring lateral restraint therein.

9. An adapter unit as defined in claim 3, wherein said elongated member is adhesively mounted to the side of the guide rail.

10. An adapter unit as defined in claim 3, wherein said elongated member comprises a plurality of sections disposed in an aligned end-to-end relationship.

11. An adapter unit as defined in claim 10, wherein said sections are assembled by an arrangement of a series of longitudinally extending pins adapted to mate with corresponding holes provided on one and the other ends of said sections.

12. An adapter unit as defined in claim 3, wherein said elongated member is made of a plastic material.

13. An adapter unit as defined in claim 12, wherein said plastic material is a polyamide.

14. An adapter unit as defined in claim 12, wherein said polyamide is nylon.

15. An adapter unit as defined in claim 3, wherein a further adapter unit is provided for mounting on the other guide rail of the door, coupling means being provided for connecting both said adapter units for joint action thereof.

16. An adapter unit as defined in claim 7, wherein a further adapter unit is provided for mounting on the other guide rail of the door, coupling means being provided for connecting the door drive means of one of the adapter units to the second end of the chain of the other one of the adapter units.

17. An adapter unit as defined in claim 16, wherein said coupling means comprises a member mounted to said second end of said other one of the adapter units and a cable joining said member to said door drive means of said one of the adapter units, said cable being guided by pulleys mounted inside the door frame at positions upwards and outwards of the door opening.

18. An adapter unit as defined in claim 17, wherein further coupling means including a further cable are provided for connecting the door drive means of said other one of said adapter units to a further member mounted to the second end of the chain of said one of the adapter units, said further cable being guided by further pulleys.

19. An adapter unit as defined in claim 3, wherein said elongated member is mounted on a side of said one guide rail opposite another side thereof defining the door opening channel.

* * * * *